United States Patent [19]

Van Wilson

[11] Patent Number: 4,646,989

[45] Date of Patent: Mar. 3, 1987

[54] TENSION CONTROL AND YARN HANDLING SYSTEM FOR "V" TYPE CREELS

[76] Inventor: Marlin Van Wilson, Rte. 1, Box 449, Barboursville, Va. 22923

[21] Appl. No.: 737,557

[22] Filed: May 22, 1985

[51] Int. Cl.[4] ..... B65H 49/02; B65H 54/71; B65H 63/00; D02H 13/08

[52] U.S. Cl. ..... 242/131.1; 242/19; 242/36; 242/157 R; 28/187; 28/193

[58] Field of Search ..... 242/19, 131, 131.1, 242/150 R, 150 M, 37 R, 36, 157 R; 250/571, 572; 57/279, 280; 28/187, 193; 66/125 R

[56] References Cited

U.S. PATENT DOCUMENTS

| | | | |
|---|---|---|---|
| 2,844,335 | 7/1958 | Freeze | 242/131.1 |
| 3,096,945 | 7/1963 | Wildi | 242/19 |
| 4,313,578 | 2/1982 | Van Wilson et al. | 242/150 M X |
| 4,566,651 | 1/1986 | Kupper | 242/150 R |

*Primary Examiner*—Stuart S. Levy
*Assistant Examiner*—David Werner
*Attorney, Agent, or Firm*—Mason, Fenwick & Lawrence

[57] ABSTRACT

A tension control and yarn handling system for a V creel system or the like comprising a plurality of mast assemblies of vertically elongated mast members arranged along parallel vertical axes and spanning the height of a yarn package array each having plural vertically spaced yarn threading stations located adjacent the respective yarn feed-off paths from the respective packages. The mast members at each yarn threading station have a yarn tension control device including confronting plate surfaces magnetically attracted together for tension control between which the yarn is drawn and have yarn threading guide devices movable collectively on the associated mast member from a raised position disposing a yarn guide slot therein in upwardly open yarn receiving condition to a lowered yarn capturning position closing said guide slot to retain yarn therein. The threading guide devices each include a yarn motion sensor providing a monitoring beam across a guide aperture of a yarn hooking slot and electronic circuitry is provided to produce defect signals signifying yarn stoppage, entanglements and defects. A yarn cutter gate device is also provided on each mast assembly adjacent each yarn path having a cutter blade and an associated pivoted guard lever arm to normally position the yarn at a non-cutting location and to expose the blade to cut the yarn when the lever arm is released from guarding position.

21 Claims, 17 Drawing Figures

47-RL
47-YL
17
17a
24
21a
21b
19
18
25
43b
43
43a 17
43
18b
18a
20

18b
18
36
25
35
38
30
37
27
17
22
47-RL
47-YL 23b
18a
18
20
23a
17
47-RL
47-YL

TENSION CONTROL AND YARN HANDLING SYSTEM FOR "V" TYPE CREELS

PRIOR RELATED APPLICATIONS

The present invention includes components disclosed in prior design patent applications of the same inventor Ser. Nos. 678,783 and 678,784 filed Dec. 5, 1984 and Ser. No. 683,132 filed Dec. 18, 1984.

BACKGROUND AND OBJECTS OF THE INVENTION

The present invention relates in general to creel systems used in connection with yarn warping operations having tension control and protective features incorporated therein, and more particularly to apparatus and method for providing tension control, yarn motion sensing and yarn cutting responsive to over tension conditions in "V" type creels and the like, providing protection from tangled yarn packages and allowing rapid thread up operator convenience.

Creels of many configurations have been used in holding yarn packages during a warping operation. One typical form of creel which has been used in warping operations is the type known in the textile industry as a "V" creel. This name relates to its "V" shape when viewed from above with the warper being located a short distance from the point or apex of the "V", and the yarn is supplied to the warper from locations lying in a substantially vertical plane along the outside of the legs of the "V". The yarn packages are typically arranged in vertical columns of packages supported by a framework such that along each leg of the "V", one set of vertical columns of packages lying in a substantially vertical plane forming an outer or exterior working or running set while another similar number of packages arranged in plural vertical columns lie in a plane spaced inwardly and parallel to the outer set along each leg forming an interior reserve set of packages. These typically are mounted on chain systems or the like to facilitate interchanging the positions of the working or outer set and the interior or reload set.

One of the purposes of the "V" type creel is to facilitate rapid change over of the yarn packages from depleted to full ones by loading full packages on the interior set associated with each leg of the "V" on suitable skewers and, at the time of change over, substituting these fully loaded skewers transported by means of conveyor chains or swing gates or truck tracks to the outer working or running position. The depleted packages are rapidly transported to the reload or interior location, for replacement of the depleted packages. Because yarn packages can be changed en masse, in the "V" type creel, the facility to vary the size of yarn or the number of ends is enhanced, and thus the "V" creel is very useful where flexibility and variety are needed.

Prior to the advent of the present invention, the "V" creel has been beset by a number of deficiencies. Foremost is the difficulty of providing means to control the tension of the yarn arriving at the warper regardless of the yarn speed or distance travelled through the atmosphere and at the same time to provide rapid group threading of the creel and tensioning means.

Typically, the previous method of providing tension on a typical "V" creel system has been to use simple hooks or wires to wrap the yarn around on its way to the warper. Tension is caused by the angle of wrap, the balloon tension as the yarn leaves the package, the distance to the warper, and the instantaneous yarn speed. The prior methods employed with "V" creels provided an unknown and extremely variable tension and was essentially uncontrollable. In order to prevent tension extremes from causing the yarn to tangle, a secondary method using yarn clamps or zig-zag snubber bars was frequently provided in the yarn path and temporarily brought into and out of use when there was danger of tangling, such as during low speed and stop conditions. This secondary type of tension override made the tension of the yarn reaching the warper even more erratic and degraded the quality of the warp and eventual fabric made from it.

Another deficiency of the prior method of "V" creel operation using the hooks or wires to cause the tension effects to serve as a broken yarn detector and stop motion for the warper was that the wires or hooks were typically hinged so that when the yarn was in position and with some minimum tension, the stop motion was held off and the warper was allowed to continue running. If the yarn broke or lost tension, the wire pivoted around and broke an electrical contact to stop the warper. This technique was very common, but well known for its propensity to collect lint or entangle yarn and fail to operate.

An object of the present invention is the provision of a novel apparatus and method for achieving tension control, sensing of yarn motion, and tangled yarn defect protection in yarn creel systems for warping operations, particularly for "V" type creels, wherein means are provided to facilitate group threadup in a manner avoiding many difficulties and inconveniences characteristic of prior systems.

Another object of the present invention is the provision of a novel apparatus and method of providing tension control for "V" and similar type creels having tension control devices of a type generally similar to those disclosed in earlier U.S. Pat. No. 4,313,578, wherein a yarn motion sensor is included in the system whereby yarn leaving the package that stops moving will cause the warper to stop in a manner which is not dependent upon tension effects and is further protected against fuzz, lint and entangled yarn.

Yet another object of the present invention is the provision, in connection with yarn tension control apparatus for "V" creels and the like, of an automatic and controllable device at a location near each yarn package such that if a yarn package becomes entangled and the yarn feed off is impeded, causing an imminent breakage, a sacrificial cut of the yarn is made automatically at a position close to the supply package to allow time for the stopmotion to stop the mass of the warper before the cut end is wrapped into and perhaps lost in the warp. If the yarn end were allowed to break, particularly at a location close to the warper, the end frequently is lost into the warp, creating a considerable quality problem.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
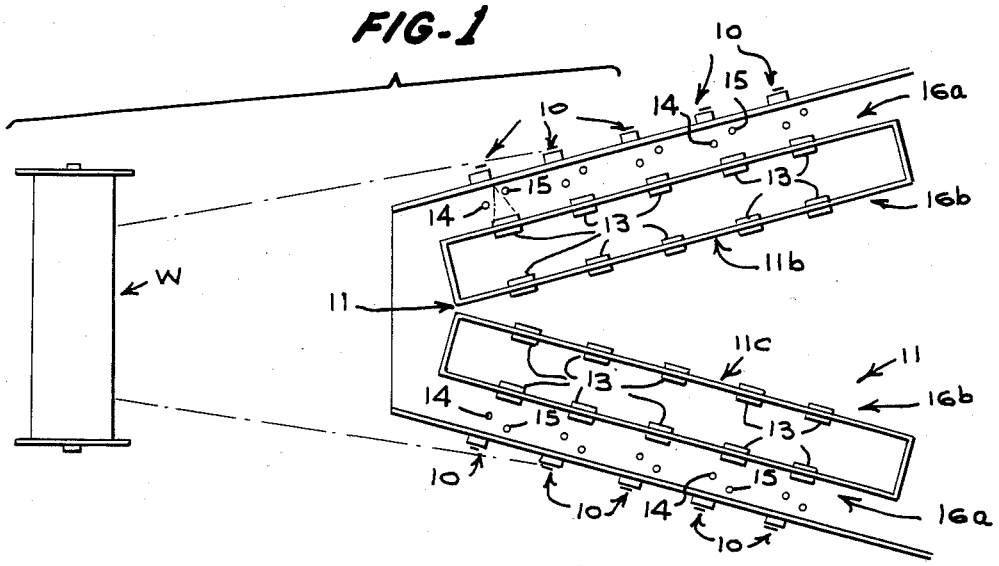
FIG. 1 is a diagrammatic perspective view of a "V" creel assembly and warper installation with tension control and yarn handling mast assemblies of the present invention employed therein.

Referring to the drawings, wherein like reference characters designate corresponding parts throughout the several figures, the apparatus of the present invention generally comprises a plurality of vertically elongated mast assemblies, indicated generally by the reference character 10, arranged in the illustrated embodiment on the two legs of a "V" creel assembly, indicated generally at 11, of generally conventional geometry, having an apex or pointed end 11*a*, and a pair of rearwardly diverging legs 11*b*, 11*c* defined by a support frame structure, for example, having upper and lower support frame legs (not shown) providing support in the usual manner for the yarn packages, indicated diagramatically at 13 and the associated vertically arranged elongated rods or bars used to snub or wrap the yarn to facilitate threadup, typically referred to as the fixed bar 14 and deadman movable bar 15. The yarn packages as will be well understood by those skilled in the art supply a large number of yarn ends from the creel 11 to a warper W. Associated with each companion set of a fixed bar 14, movable bar 15 and yarn package 13 is one of the mast assemblies 10 of the present invention, all of these sets being arranged as a first yarn package set 16*a* and a second yarn package set 16*b* for each leg 11*b*, 11*c* of the "V", including the associated bars and mast assembly for each. One package set 16*a*, 16*b* is positioned outwardly of the center plane of the associated "V" creel leg 11*b* or 11*c* in what is frequently referred to as the running position and the other package set 16*a*, 16*b* is located inwardly of the center plane of the associated "V" creel leg in what is referred to as the reload position. Typically, the yarn packages 13 are arranged as close together as is practical to save space in an orderly matrix in an arrangement which is well known to those skilled in the art.

The vertical mast assemblies 10 associated with each companion set of a yarn package 13, fixed bar 14 and deadman movable bar 15 comprises a U shaped vertically elonged rigid channel member 17 and a smaller slider rail or slide bar member 18 which is vertically elongated to span most of the height of the mast channel member 17 and is slidably carried by the mast channel member 17. In the illustrated embodiment, the slider rail or bar member 18 is of right angle configuration providing a wider main flange member 18*a* and a narrow flange member 18*b* at right angles thereto to rigidify the rail or bar member and extend perpendicular to the main flange member 18*a* toward the base web 17*a* of the mast channel member.

The base web portion 17*a* of the mast channel member 17 has a plurality of vertically elongated slots 19 and the slider rail or bar member 18 has a spacer block 20, for example of teflon or similar low surface friction material secured thereto by screw fasteners or the like and having a slide limiting screw 21 fastened in the spacer block 20 and extending through the slot 19, having an enlarged head 21*a* located on the opposite side of the base wall 17*a* of the mast channel member 17 from the spacer block 20 and an associated enlarged washer 21*b* of greater outer diameter than the width of the slot 19 to capture the screw 21 in the slot 19. In the illustrated embodiment, the slots 19 are of sufficient length such that the slider rail or bar member 18 is capable of relative vertical movement of approximately 2 inches with respect to the mast channel member 17 when actuated by an air cylinder AC either coupled by a conventional linkage mechanism LM to a plurality of such slider rail or bar members 18 at the top thereof, controlled from an electronic console.

Interposed between the masts 17 and the yarn packages 13 are the arrangments of movable rods formed by the fixed rod or bar 14 and the deadman movable rod or bar 15 used to snub or wrap the yarn during threadup. The deadman movable bars 15 are movable so as not to interfere with the yarn tension once threadup is completed and warping is started. Horizontal translation of the movable deadman bar or rod 15 associated with each mast 17 and each vertically aligned set of yarn passages 13 is accomplished in conventional manner by air cylinders (not shown) at the top and bottom of the "V" creel with suitable guides.

Each of the mast channel members 17 support a plurality of vertically spaced yarn tension controlled devices, for example of the type shown in FIG. 8–11 of U.S. Pat. No. 4,313,578 granted Feb. 2, 1982 to Marlin Van Wilson et al and described in the associated portions of the specificiation of that patent, with electronic controls of the kind disclosed in that patent. Each of the tension devices, indicated at 22 in the drawings of the present application, includes a pair of confronting wear surface discs 23*a*, 23*b*, with an associated low rpm electric motor 24 rotating the wear disc 23*a* in an advancing direction relative to the feed direction of the yarn engaged by the disc at a slower speed than the confronting portions of the yarn moving along the yarn path. The other disc 23*b* is magnetically attracted toward the companion disc 23*a* by an electromagnet as disclosed in said earlier patent, activated by electronic circuitry of the type disclosed therein. One of the yarn tension control devices 22 is provided for each yarn package and the yarn from the associated package is drawn from the package about the associated fixed and movable bars or rods 14, 15 and through a notch 25 defined by a threading hook and motion sensor unit 26 as later described carried by the slider 18 at each yarn station along the yarn path to the associated tension device 22. This yarn is also drawn through the yarn passage defined by a yarn cutter gate unit 27 at each yarn station adjacent the associated tension device 22. The details of the threading hook and motion sensor unit 26 and yarn cutter gate 27 will be described later.

The threadup routine for the device, generally described, involves raising all of the mast sliders 18 simultaneously and moving the deadman bars 15 into the closed or snubbing position. Each deadman bar 15 in conventional manner hangs on an offset pin so that the operator may open each deadman and reach with his hand through to grasp all the yarn ends in the vertical row. All yarn ends in this column are pulled forward and with an easily learned motion, swept into the mast hook notches 25 defined by the threading hook and motion sensor units 26. This operation is repeated for each individual mast 17 until the yarn of the entire side of the creels is engaged in the notches 25 of the threading hook units 26 and "horsetails" are hanging limply to the floor.

The operator then gathers perhaps as many as ten to fifteen of the "horsetails" and carries them forward to insert and secure in the warper comb of the conventional warper unit W. The operation is repeated until all "horsetails" are carried forward and secured. During this carrying forward, a small tension is created by the deadman bars 15 and the yarn is urged into the crotch 18*f'* of the associated fin formations 18*f* on the sliders 18, providing alignment so that when the sliders 18 on each mast 17 are lowered, the yarn is guided into and between the tension plates or discs 23*a*, 23*b* of the associated tension devices 22.

When the yarn is guided between the discs 23*a*, 23*b* of the tension devices 22, tension commands from the electronic circuitry are at zero and the discs 23*a*, 23*b* are without cling or pressure. After the yarn is positioned between the discs of the tension unit 22, the electronic circuitry increases the tension command to maximum and places the yarn in a condition facilitating threading of the individual ends into the warper comb. After the warper comb is threaded, the electronic circuitry reduces the tension to the low speed run value as described in U.S. Pat. No. 4,313,578 and the warping is begun. The deadman rod-controlling-air-cylinders are activated at this time to remove the snubbing action and cause no interference to the yarn.

Figure 10:
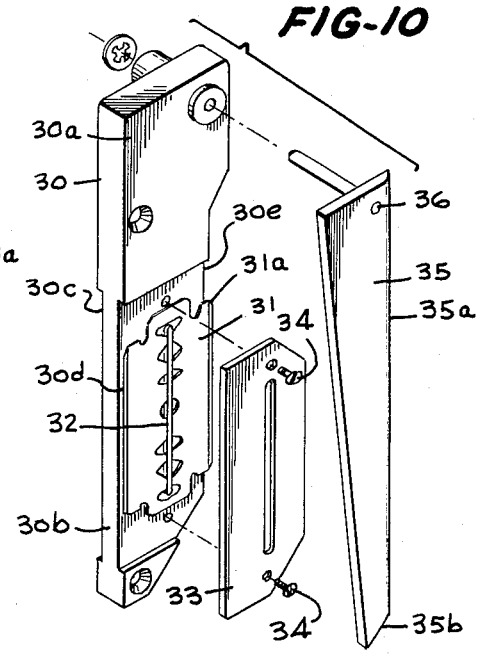
FIG. 10 is an exploded front perspective view of the yarn cutter gate unit provided at each yarn feed path and tensioning station on the mast.
Figure 11:
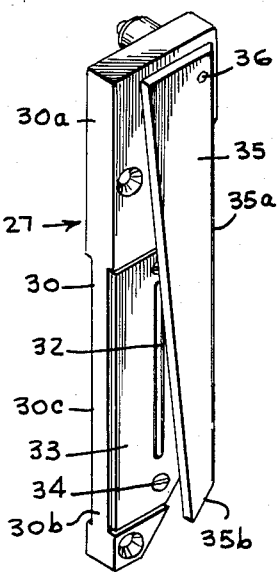
FIG. 11 is a front perspective view of the yarn cutter gate unit.

The yarn cutter gate unit 27 of the present invention, mounted on the slider or slide bar 18 at each yarn passage station adjacent each tensioning device 22 and companion notch 25 comprises a main plastic body 30 which is vertically elongated as shown, having a generally rectangular upper body portion 30*a*, a lower truncated right trianglular portion 30*b* near the lower end thereof, and an intermediate shallower portion 30*c* providing a cutter receptor well 30*d* for removably receiving and supporting a cutter blade 31 which, in the illustrated embodiment, is a double edge razor blade of conventional construction. The cutter receptor well 30*d* has a vertically elongated locator rib 32 of appropriate size to receive the elongated center slot of the conventional razor blade 31 while locating the blade so that one blade portion, for example 31*a* thereof, protrudes beyond the adjoining vertical end surface portion 30*e* of the mid portion of the cutter unit body 30, as best illustrated in FIG. 10. A retaining plate 33 of appropriate shape having a center slot for receiving the adjacent edge portion of the locator rib 32 and having apertures for securing screws 34 is provided, to fit over the removable cutter blade 31 to retain the same in position. Appropriately located threaded tapped sockets are provided in the base surface portion of the cutter blade receptor well 30*d* for removably threading the screws 34 therein.

A pivoted gate arm 35 pivoted at 36 to the body portion 30*a* near the uppermost end thereof spans substantially the vertical length of the cutter gate unit 27 and has a smooth rounded working edge 35*a* which is normally in contact with the yarn and normally occupies a position preventing the yarn from contacting the sharp edge of the razor blade or other cutter 31. The pivoted gate-forming arm 35 is of magnetic conductive material pivoted to swing so as to prevent or allow the yarn to contact the sharp edge of the razor blade or cutter 31. The lower end of the gate-forming arm 35 in the illustrated embodiment is provided with an inclined lower end 35*b* designed to normally be drawn into contact with a similarly inclined electromagnet pole face 37 of an an electromagnet pole member 38 extending through a slot in the slider 18 from the threading hook and motion sensor unit 26 and conditioned in a magnetized or non-magnetized condition by circuitry associated with the unit 26 as later described. Normally, the gate member 35 is held in the position illustrated in FIG. 5 by the magnetic force of the electromagnet magnetizing the pole member 38 to cause the yarn to clear the cutting edge of the cutter blade 31.

This yarn gate and cutting device 27 overcomes deficiencies which have been observed in yarn cutters of the past. It is important that the path of yarn flow turn as little as possible as larger turns create undesired drag and yarn tension. Previous yarn cutter designs required large angles of wrap to operate and thereby were inadequate. Previous yarn cutters relied on springs to hold the yarn clear of a cutting element. The disadvantage of this is that if the yarn tension rose gradually, as when a winding layer has slipped, the spring could be gradually compressed and allow the yarn to chafe on the cutting element and cause long lengths of damaged yarn. A third deficiency of previous yarn cutters is the difficulty in adjusting a large number of springs when a different size yarn is to be run.

The yarn cutter gate unit 27 of the present invention overcomes these deficiencies. It requires a yarn angle of only 90° or less for satisfactory operation, and an angle of this amount is normal in a typical creel in any event, and the unit 27 is so mounted as to make use of this existing angle and yet not to increase it. Further, the smooth rounded gate surface 35*a* with the gate 35 of magnetic conductive material swings so as to prevent contact with, or allow the yarn to contact, the sharp cutting edge, and is normally held in position to cause the yarn to clear the cutting edge by magnetization of the electromagnet pole 38. If the tension of the yarn rises, whether gradually or quickly, the magnetic pull on the gate lever 35 by the electromagnet pole 38 will hold until the yarn tension is high enough to break away the magnetic pole. The highest break away force is when the gate is in contact with the electromagnet pole face 37. Once the gate lever 35 separates slightly from the pole face 37, the attraction drops quickly to near zero and allows the yarn tension that caused the breakaway to be used totally for a cutting action. This is the reverse of the spring action in the prior devices and removes the possibility of chaffing and damaging a long length of yarn. Furthermore, this yarn cutter gate arrangement provides the advantage that all the electromagnets for magnetizing and terminating the magnetic force on the magnetic pole members 38 can be wired together and adjusted from one control for the entire creel. Thus if a heavy yarn is run, the electromagnet voltage for all of the cutters can be simultaneously increased and if a light yarn is run, it can be quickly decreased.

Figure 12:
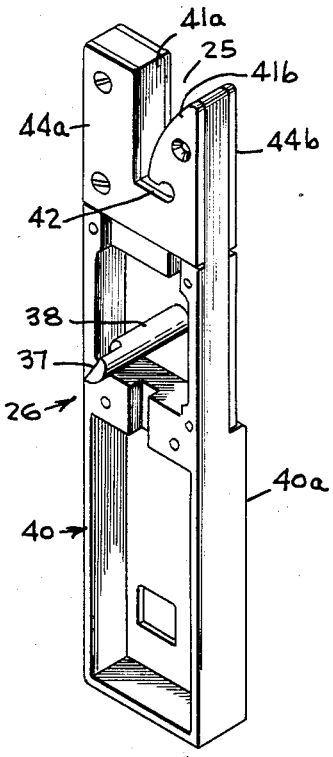
FIG. 12 is a rear perspective view of the yarn hook and motion sensor unit associated with each yarn path and tensioning station on each mast assembly.
Figure 13:
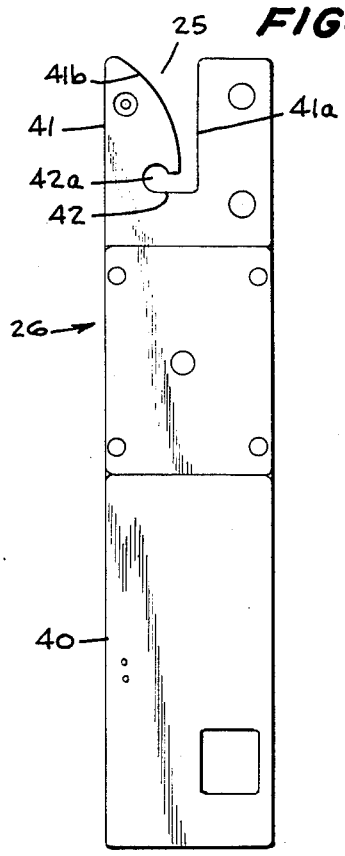
FIG. 13 is a front elevational view of the yarn threading hook and motion sensor unit.
Figure 14:
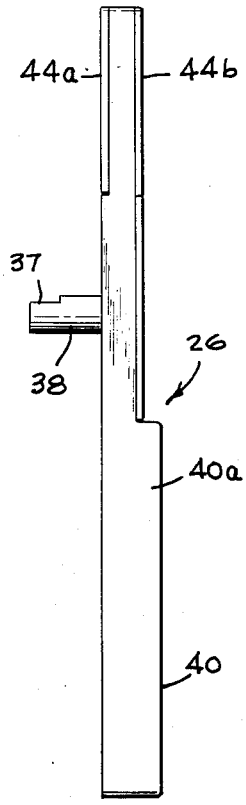
FIG. 14 is an end elevational view of the yarn threading hook and motion sensor unit, viewed from the left of FIG. 13.

The threading hook and motion sensor unit 26, one of which is provided adjacent each yarn tension device 22 on the slider 18 and adjacent a companion yarn cutter gate unit 27, is in the form of a vertically elongated generally rectangular module 40, formed of a molded plastic body of the configuration shown in FIGS. 12 and 13,14 and defines the notch 25 previously referred to having a generally right angular configuration as best shown in FIG. including an entrance leg or throat portion 41 forming a convergent throat having a straight side 41*a* and a convexly curving or arcuate side 41*b* extending in downwardly converging paths to join the horizontal notched leg 42 which terminates in a generally circular slightly enlarged terminus 42*a*. The straight vertical side 41*a* of the throat portion 41 of the notch 25 is aligned with the side 17*b* of the channel shaped post 17 and a fin member 43 is provided on each post adjacent each yarn tensioning device 22, projecting outwardly a short distance from the side, 17*b* of the channel 17 providing a vertical edge 43*a* which aligns with the juncture of the circular terminus 42*a* of the notched leg 42 with the remained of the leg 42, and having an inclined ramp edge 43*b* forming a guide ramp to guide the yarn in the notch 25 when it is at the lower end portion of the notched leg 41 laterally into the terminus 42*a* as the slider 18 is lowered from the uppermost position to the lower normal position. The threading hook and yarn sensor unit includes two hardened metallic hook forming plates 44*a*, 44*b* separated by a thickness of plastic forming the body 40 of the unit 26 and defining the hook shaped notch 25 having the legs 41 and 42 previously described. The plastic body also has cavities to house motion sensing elements in close proximity to the yarn hook formation 41, 42. When the slider 18 of the mast is lowered into the running position from the threading position, the fin member 43 as described closes the opening of the hook shaped notch 41, 42 and creates a fully encircled aperture at the terminus portion 42*a* of the hook shaped notch for the yarn to pass through from the yarn package so that the violent movement of the yarn balloon will not unthread the hook. By this construction, the yarn is easy to thread, the motion sensor is located near the yarn package, and the yarn is secured in the proper path during run conditions.

Figure 16:
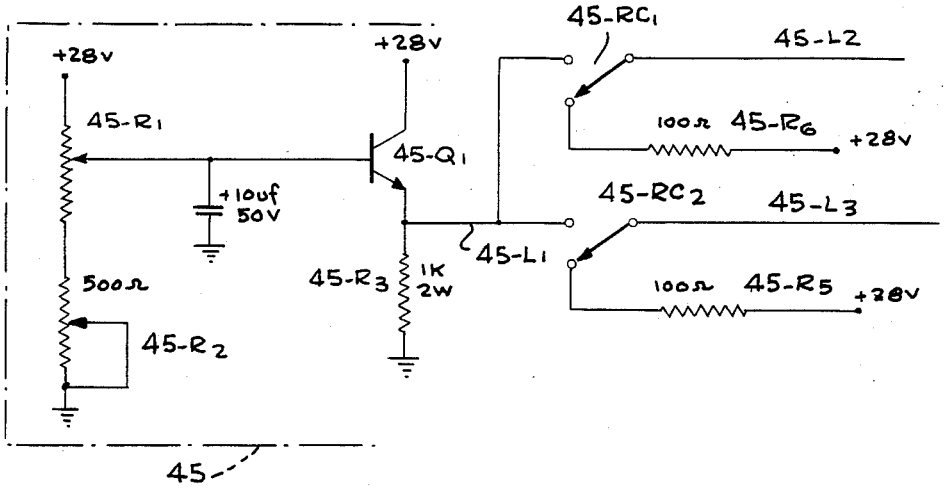
FIG. 16 is a fragmentary schematic diagram of a circuit for supplying the current to the electromagnet coils for the pole coactive with the yarn cutter gate lever.

The electromagnet pole 38 in the form of a cylindrical rod having a half cylindrical cut in the end portion thereof forming a 45° surface providing the electromagnet pole face 37 to be contacted by the gate lever 35, is magnetized throughout operation of the system by providing an electromagnet winding or coil wound on a plastic bobbin (not shown) housed within the mid portion of the threading hook and motion sensor unit 26, which is normally supplied with a previously manually set voltage level providing the desired magnetic attractive force for holding the lower free end portion of the gate lever 35 against the inclined pole face 37, and which when the warper is stopped, is supplied through relay contacts with a stronger voltage (plus 28 volts) to more securely magnetically hold the associated gate lever 35 in the shielding or protective position preventing the yarn from contacting the sharp cutting edge of the cutter blade 31, for example during of the yarn package sets 16*a*, 16*b* between running position and reload position. An example of circuitry for accomplishing this is shown in the fragmentary schematic diagram of FIG. 16, indicated generally by the reference character 45. As illustrated, the basic plus 28 volt supply is provided across a yarn cutter adjust potentiometer 45-R1 and a minimum cut adjust potentiometer 45-R2, and the voltage at the movable contact at the potentiometer 45-R1 is supplied to the base of transitor 45-Q1 connected through a resister 45-R3 to ground and through a lead 45-L1 to cutter relay contacts 45-RC1 and 45-RC2, when in the upper or closed position during normal operation of the warper, to leads 45-L2 and 45-L3 to supply voltage to the electromagnet coils for the electromagnet pole members 38 as determined by the potentiometer adjustments. Control circuitry from a control console activates the relay coil for the cutter relay controlling the contacts 45-RC1 and 45-RC2 maintaining them in the up position of FIG. 16 when the warper is in normal operation, and allowing these contacts to shift to the down position of FIG. 16 when the warper is stopped, to apply the plus 28 volts supply through resisters for example 45-R5 and 45-R6 to the leads 45-L2 and 45-L3 supplying the electromagnet coil windings for the electromagnet pole members, providing a stronger magnetizing force as described.

Figure 15:
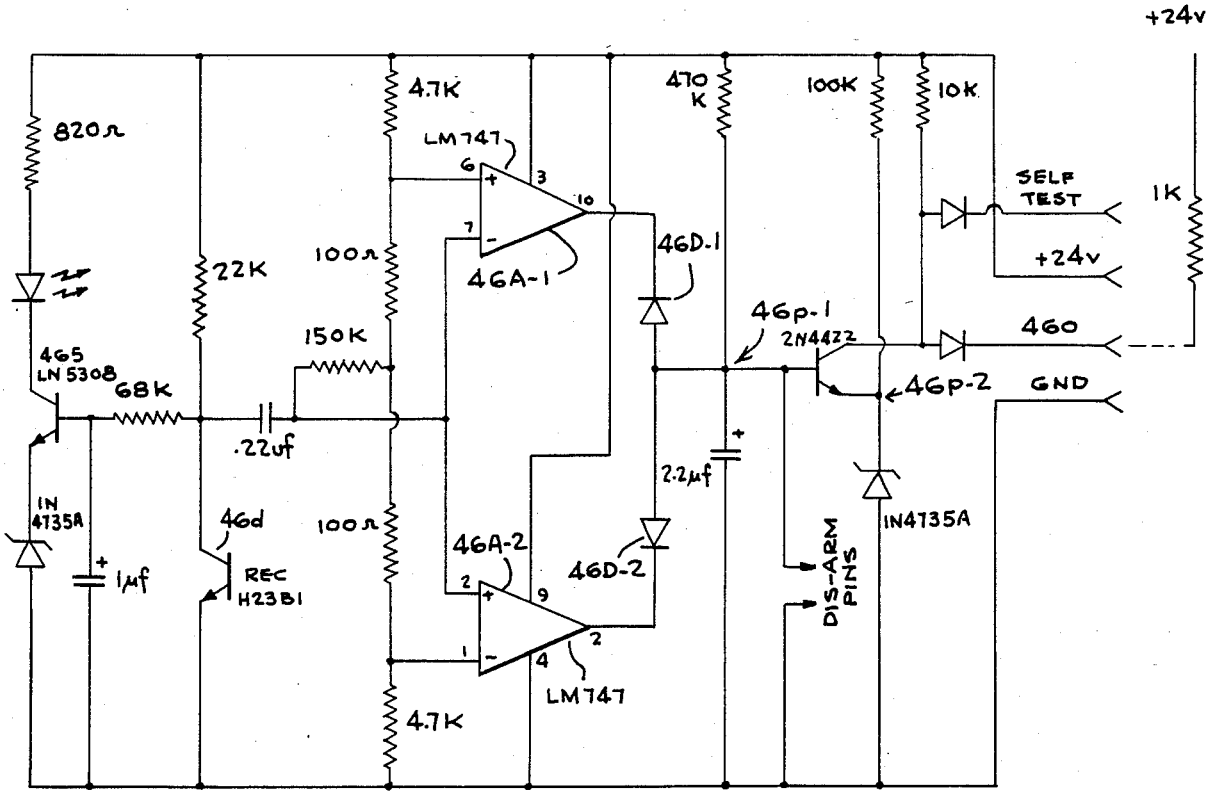
FIG. 15 is a fragmentary schematic diagram showing an embodiment of circuitry for the yarn motion sensor.
Figure 2:
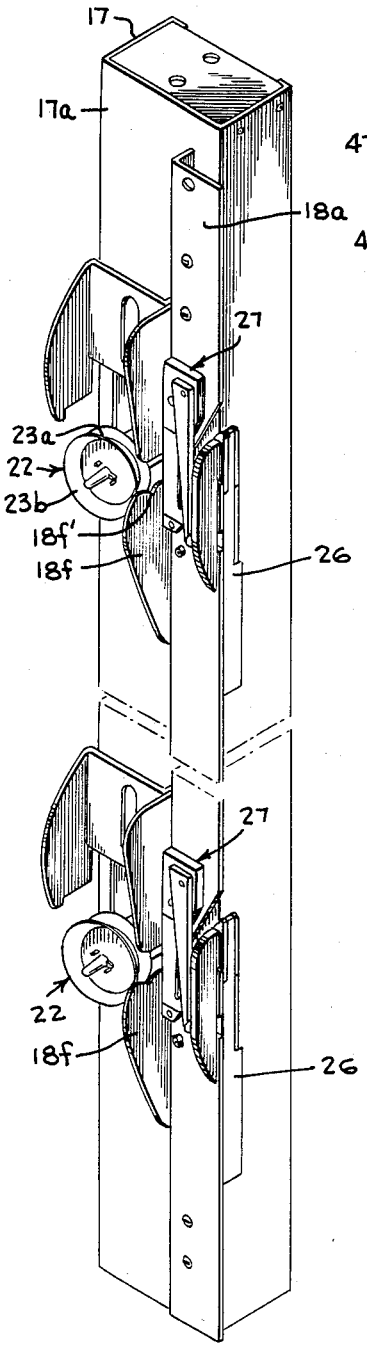
FIG. 2 is a front perspective view, viewed from one side, of one of the mast assemblies of the present invention, broken away to indicate only the uppermost and lowermost yarn tension control and handling sections thereof.
Figure 3:
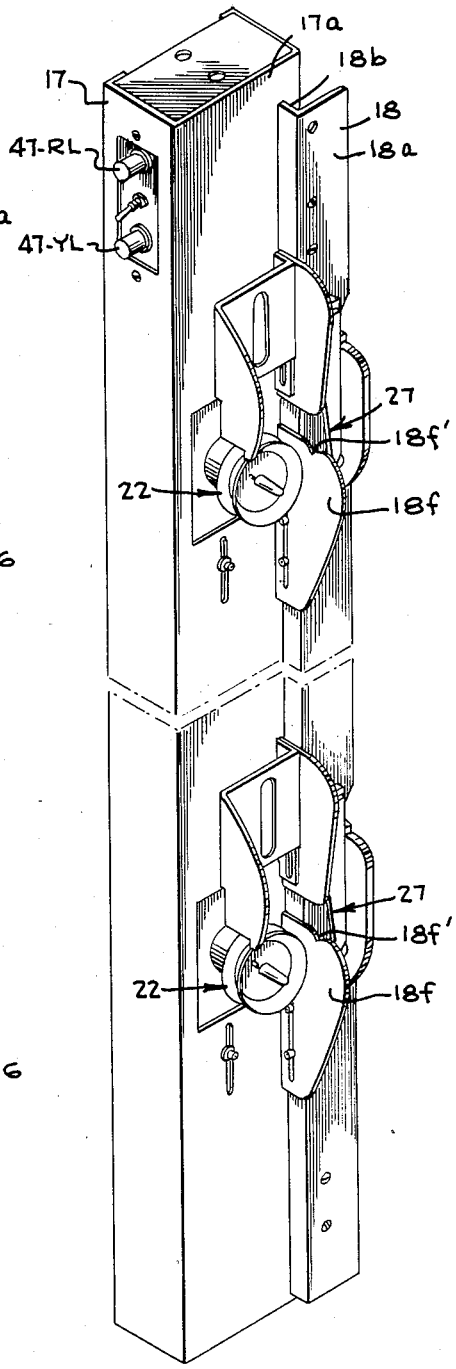
FIG. 3 is a front perspective view, viewed from the opposite side of the mast assembly illustrated in FIG. 2.
Figure 4:
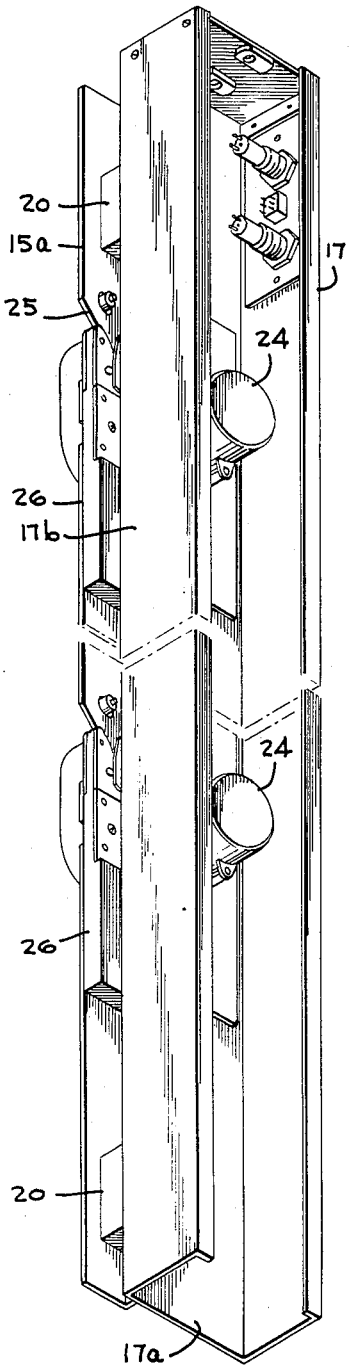
FIG. 4 is a rear perspective view of the mast assembly shown in FIG. 2.
Figures 5, 6, 7, 8:
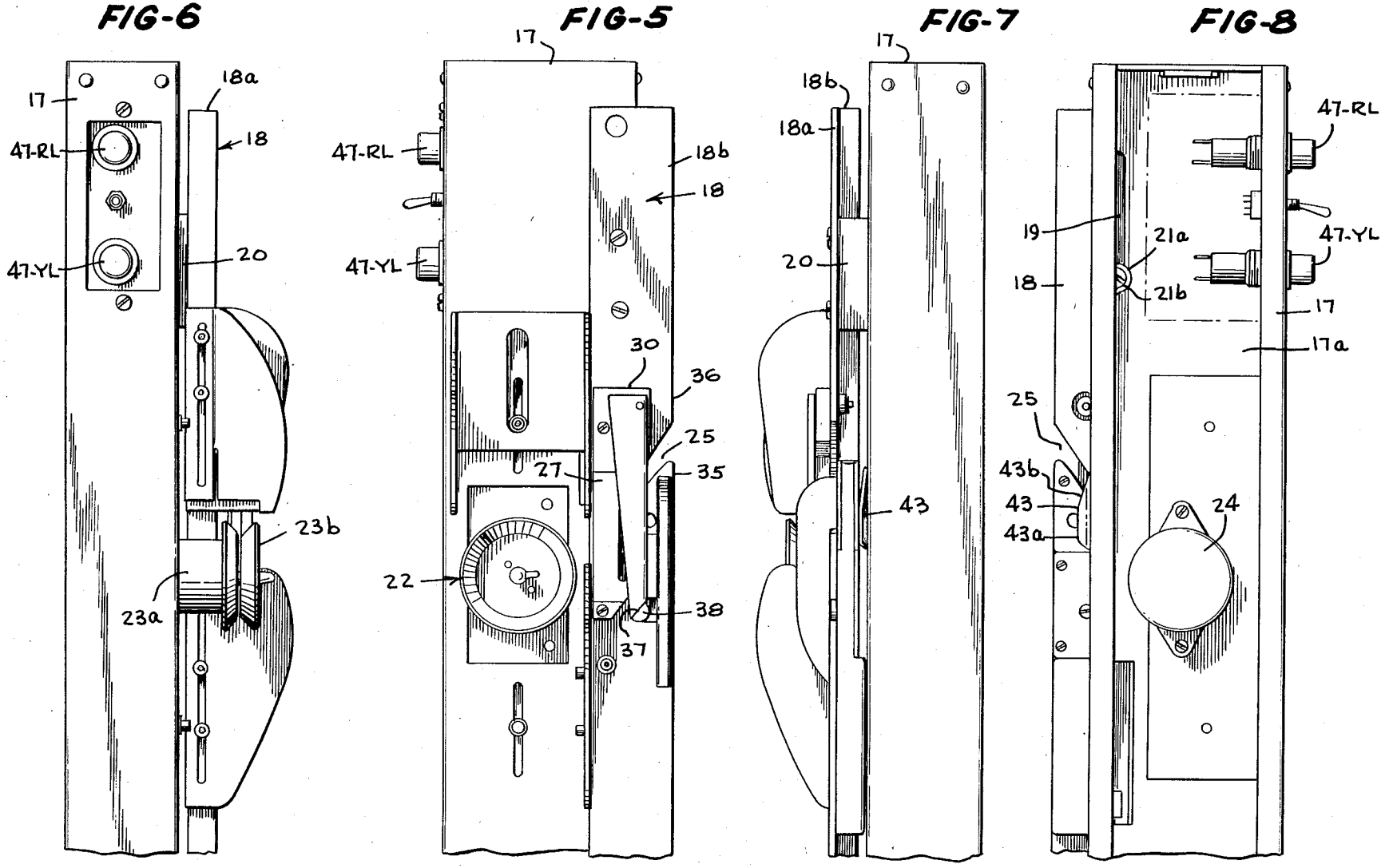
FIG. 5 is a fragmentary front elevational view of the uppermost portion of one of the mast assemblies showing the yarn tension control and yarn handling components mounted thereon.
FIGS. 6 and 7 are fragmentary end elevational views of the uppermost mast assembly portions shown in FIG. 5, viewed from the left hand and right hand sides of FIG. 5 respectively.
FIG. 8 is a rear elevational view of the uppermost portion of the mast assembly shown in FIG. 5.
Figure 9:
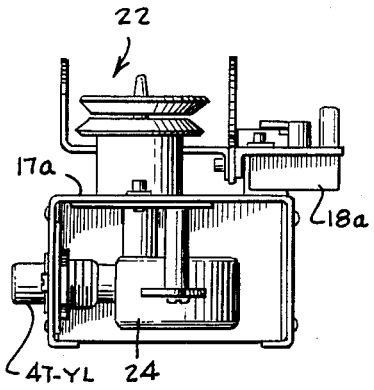
FIG. 9 is a bottom plan of the mast assembly.

The yarn motion sensors may be any one of several known types, but in the illustrated embodiment shown schematically in FIG. 15, are housed in the upper notched head portion of the threading hook and motion sensor unit between the two hardened metallic plates 44*a*, 44*b* and within the plastic forming the body 40*a* and each include a LED light source 46S and associated photodetector 46*d* located diametrically opposite each other, for example along a vertical axis, to monitor the center portion of the circular terminus 42*a* of the notch 25, connected as shown in the schematic circuit of FIG. 15 to a small amplifier formed of a pair of high gain operational amplifiers 46A-1, 46A-2 and a pair of signal rectifiers 46D-1, 46D-2. The point 46*p*-1 normally runs near zero volts when yarn is moving and causes voltage to rise above threshold level at point 46*p*-2 to turn on Q17 to provide an output signal on lead 46*o* when yarn stoppage occurs or when fuzz and lint occlude the hook eye or circular terminus 42*a*.

Figure 17:
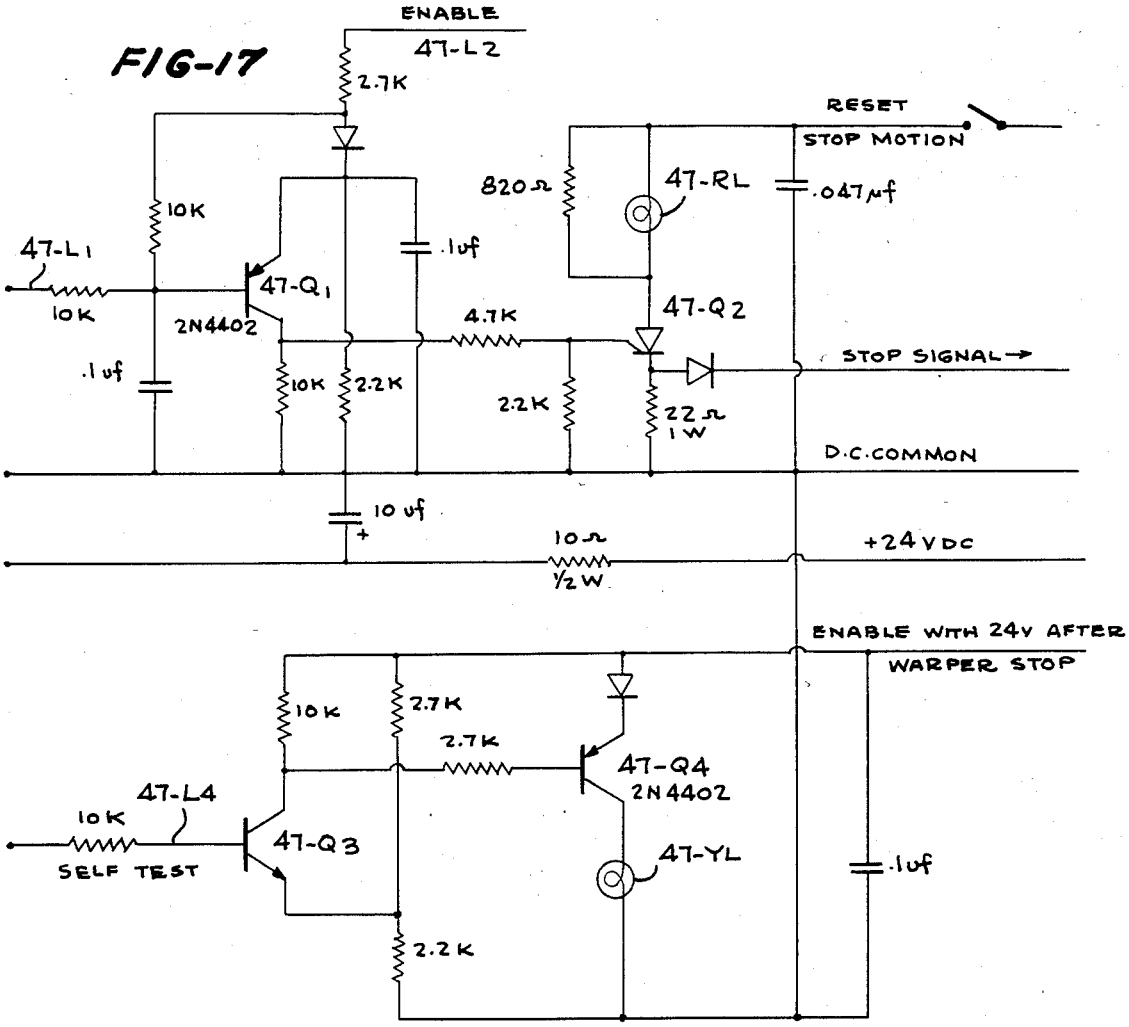
FIG. 17 is a fragmentary schematic diagram of circuitry for the signalling lamps for each mast assembly.

At the top of each mast assembly is provided a signalling unit, shown schematically in FIG. 17, and indicated by reference character 47, containing electronic components mounted on a printed circuit board and two different colored signalling lights, a red lamp 47RL and a yellow lamp 47YL. The inputs from all motion sensors on the associated mast are brought to the signalling unit on the imput lead 47-L1 and controls the voltage on the base of the transistor 47-Q1. The collector output of 47-Q1 drives through a resistor network the gate of silicon controlled rectifier 47-Q2 connected as shown. Whenever any one of the motion sensors 46 on the associated mast detects a yarn stoppage or fuzz and lint occluding the hook eye or circular terminus 42*a*, a voltage change occurs, which will cause the SCR 47-Q2 to trigger and current will pass through and light the red lamp 47-RL. The SCR 47-Q2, because of its inherent design, will latch into this conductive condition and maintain the red lamp 47-RL in on condition regardless of input conditions, and thus the red light emitted by the lamp 47-Q2 identifies the mast with a yarn defect.

Further, means may be provided to sense the slowing and stopping of the warper at the central console of the "V" creel system to remove voltage from the lead 47-L2, labelled "enable" of this signalling module and all others in the creel. This is to prevent all other modules or mast assemblies from signalling that the yarn is stopping because the warper is stopping. Removing the "enable" voltage, which supplies transitors 47-Q1 equivalents on all mast signal modules, prevents the stop signals from turning on all the red lamps 47-RL in the creel on other than the mast that has caused the stop. When the yarn defect has been repaired and the warper restarted, means in the console sensing acceleration of the warper may be provided to momentarily remove the voltage from the reset lead 47-L3 and turn off the one red signal lamp 47-RL that caused the stop.

Other features of this signalling system include provision of a self test lead 47-L4 and transistors 47-Q3 and 47-Q4, and their supply voltage from lead 47-L5 labelled "Self Test". When the warper comes to a complete stop, and no yarn should be moving anywhere in the creel, the central console would supply a voltage at the lead 47-L5 and activate the self test feature. The base of transistor 47-Q3 is driven by the motion sensors, and if one or more on the associated mast indicate that yarn is moving in their location, the signal will be amplified by transistor 47-Q3 and applied to transistor 47-Q4. This will cause 47-Q4 to conduct and pass current through the yellow lamp 47-YL causing it to illuminate. The yellow lamp 47-Y1 indicates that yarn is moving while the warper is stopped. If the operator is not manually pulling the yarn, the indication signalled is that of a malfunction. This provides for self checking and repair and prevents a malfunction from allowing continued operation with a broken yarn end. This further increases the trustworthiness of the system and creates higher quality warps.

I claim:

1. Apparatus for a V creel system or the like of yarn packages associated with a warper facilitating group yarn threadup through tension control means and yarn sensor and treating means from an array of plural vertical columns and horizontal rows of yarn packages arranged in a vertical supply creel plane, comprising a plurality of mast assemblies of vertically elongated mast members arranged along parallel vertical axes and each mast spanning the total height of the yarn package array, the mast members being located close to the yarn supply packages and maintained in vertical parallelism in a mast plane parelleling said creel plane and each having plural vertically spaced yarn threading stations located adjacent the respective yarn feed-off paths from the respective packages, the mast members at each yarn threading station having a yarn tension control device including confornting plate surfaces mangetically attracted together for tension control between which the yarn is drawn and having vertically spaced plural yarn threading guide means at the respective threading stations movable collectively on slide means of the associated mast member from a raised portion disposing a yarn guide slot therein in upwardly open yarn receiving condition to a lowered yarn capturing position closing said guide slot to retain yarn therein.

2. Apparatus as defined in claim 1, wherein said plate surfaces of said tension control devices are surfaces of a pair of discs concentric with a common axis, at least one of which is magnetically attracted toward the other by an electromagnet energized by electronic yarn tension control means.

3. Apparatus as defined in claim 2, wherein said slide means is a vertically elongated slide bar member movably supported in each said mast member and spans substantially the height thereof, said yarn threading guide means being carried on said slide bar and including a yarn hooking slot of angular shape having an upwardly opening and upwardly diverging entrance throat portion and a laterally extending lower leg portion joined therewith for guiding yarn downwardly through said entrance throat portion into said leg portion when the slide bar member is in raised position, and said mast member having abutment formations respectively adjacent said guide means to engage and urge yarn into said lower leg portion as the slide bar member is lowered and shaped to form a yarn-capturing guide aperture in a terminus of said leg portion.

4. Apparatus as defined in claim 3 wherein said threading guide means includes a yarn motion sensor comprising light emitting and sensing means providing a monitoring beam across said guide aperture of said yarn hooking slot and electronic circuitry associated therewith responsive to beam variations to produce defect signals signifying yarn stoppage, entanglements and defects.

5. Apparatus as defined in claim 4, including a yarn cutter gate device on each mast assembly adjacent the portion of each yarn path between said yarn threading guide means and the associated tension control device, each yarn cutter gate device including a cutter blade and blade support member positioning a cutting edge of the blade at a location to cut the yarn being drawn by the warper along each yarn path portion when not guarded against contact with said cutting edge, a gate-forming guard lever arm, pivoted near its upper end and having a vertically elongated gate edge intercepting the yarn path to engage the yarn and space it from the cutting edge and having a lower end for abutment with a magnet pole member, an electromagnet for magnetically attracting the guard lever arm to abut the pole member at a position causing the yarn to clear the cutting edge, the guard lever arm being pivoted to break away from the pole member when yarn tension reaches a predetermined value and expose the yarn to be cut by the cutting edge.

6. Apparatus as defined in claim 4, including signalling means including a lamp and associated signal circuitry on each mast assembly in the upper portion thereof electrically coupled to all of the yarn motion sensors of the associated mast assembly, the signal circuitry having means for illuminating said lamp when any of the yarn motion sensors of its associated mast detects a yarn stoppage or changes indicating fuzz or lint occurring in the portion of the associated yarn guide slot normally occupied by the yarn and means maintaining the illuminated lamp in on condition until manually deactivated.

7. Apparatus as defined in claim 3, including a yarn cutter gate device on each mast assembly adjacent the portion of each yarn path between said yarn threading guide means and the associated tension control device, each yarn cutter gate device including a cutter blade and blade support member positioning a cutting edge of the blade at a location to cut the yarn being drawn by the warper along each yarn path portion when not guarded against contact with said cutting edge, a gate-forming guard lever arm, pivoted near its upper end and having a vertically elongated gate edge intercepting the yarn path to engage the yarn and space it from the cutting edge and having a lower end for abutment with a magnet pole member, an electromagnet for magnetically attracting the guard lever arm to abut the pole member at a position causing the yarn to clear the cutting edge, the guard lever arm being pivoted to break away from the pole member when yarn tension reaches a predetermined value and expose the yarn to cut by the cutting edge.

8. Apparatus as defined in claim 2 wherein said threading guide means includes a yarn motion sensor comprising light emitting and sensing means providing a monitoring beam across said yarn guide slot and electronic circuitry associated therewith responsive to beam variations to produce defect signals signifying yarn stoppage, entanglements and defects.

9. Apparatus as defined in claim 8, including signalling means including a lamp and associated signal circuitry on each mast assembly in the upper portion thereof electrically coupled to all of the yarn motion sensors of the associated mast assembly, the signal circuitry having means for illuminating said lamp when any of the yarn motion sensors of its associated mast detects a yarn stoppage or changes indicating fuzz or lint occurring in the portion of the associated yarn guide slot normally occupied by the yarn and means maintaining the illuminated lamp in on condition until manually deactivated.

10. Apparatus as defined in claim 2, including a yarn cutter gate device on each mast assembly adjacent the portion of each yarn path between said yarn threading guide means and the associated tension control device, each yarn cutter gate device including a cutter blade and blade support member positioning a cutting edge of the blade at a location to cut the yarn being drawn by the warper along each said yarn path portion when not guarded against contact with said cutting edge, a gate-forming guard lever arm pivoted near its upper end and having a vertically elongated gate edge intercepting the yarn path to engage the yarn and space it from the cutting edge and having a lower end for abutment with a magnet pole member, an electromagnet for magnetically attracting the guard lever arm to abut the pole member at a position causing the yarn to clear the cutting edge, the guard lever arm being pivoted to break away from the pole member when yarn tension reaches a predetermined value and expose the yarn to be cut by the cutting edge.

11. Apparatus as defined in claim 1, wherein said shoe means is a vertically elongated slide bar member movably supported in each said mast member and spans substantially the height thereof, said yarn threading guide means being carried on said slide bar and including a yarn hooking slot of angular shape having an upwardly opening and upwardly diverging entrance throat portion and a laterally extending lower leg portion joined therewith for guiding yarn downwardly through said entrance throat portion into said leg portion when the slide bar member is in raised position, and said mast member having abutment formations respectively adjacent said guide means to engage and urge yarn into said lower leg portion as the slide bar member is lowered and shaped to form a yarn-capturing guide aperture in a terminus of said leg portion.

12. Apparatus as defined in claim 11 wherein said threading guide means includes a yarn motion sensor comprising light emitting and sensing means providing a monitoring beam across said guide aperture of said yarn hooking slot and electronic circuitry associated therewith responsive to beam variations to produce defect signals signifying yarn stoppage, entanglements and defects.

13. Apparatus as defined in claim 12, including signalling means including a lamp and associated signal circuitry on each mast assembly in the upper portion thereof electrically coupled to all of the yarn motion sensors of the associated mast assembly, the signal circuitry having means for illuminating said lamp when any of the yarn motion sensors of its associated mast detects a yarn stoppage or changes indicating fuzz or lint occurring in the portion of the associated yarn guide slot normally occupied by the yarn, and means maintaining the illuminated lamp in on condition until manually deactivated.

14. Apparatus as defined in claim 12, including a yarn cutter gate device on each mast assembly adjacent the portion of each yarn path between said yarn threading guide means and the associated tension control device, each yarn cutter gate device including a cutter blade and blade support member positioning a cutting edge of the blade at a location to cut the yarn being drawn by the warper along each yarn path portion when not guarded against contact with said cutting edge, a gate-forming guard lever arm, pivoted near its upper end and having a vertically elongated gate edge intercepting the yarn path to engage the yarn and space it from the cutting edge and having a lower end for abutment with a magnet pole member, an electromagnet for magnetically attracting the guard lever arm to abut the pole member at a position causing the yarn to clear the cutting edge, the guard lever arm being pivoted to break away from the pole member when yarn tension reaches a predetermined value and expose the yarn to be cut by the cutting edge.

15. Apparatus as defined in claim 12, including self-test means operative upon stopping of the associated warper to sense whether any yarn is moving through any of said motion sensors and illuminate a distinctive signal lamp on any of said masts having yarn moving through any of the motion sensors on said last-mentioned mast to indicate that yarn is moving while the warper is stopped.

16. Apparatus as defined in claim 11, including a yarn cutter gate device on each mast assembly adjacent the portion of each yarn path between said yarn threading guide means and the associated tension control device, each yarn cutter gate device including a cutter blade and blade support member positioning a cutting edge of the blade at a location to cut the yarn being drawn by the warper along each said yarn path portion when not guarded against contact with said cutting edge a gate-forming guard lever arm pivoted near its upper end and having a vertically elongated gate edge intercepting the yarn path to engage the yarn and space it from the cutting edge and having a lower end for abutment with a magnet pole member, an electromagnet for magnetically attracting the guard lever arm to abut the pole member at a position causing the yarn to clear the cutting edge, the guard lever arm being pivoted to break away from the pole member when yarn tension reaches a predetermined value and expose the yarn to be cut by the cutting edge.

17. Apparatus as defined in claim 1 wherein said threading guide means includes a yarn motion sensor comprising light emitting and sensing means providing a monitoring beam across said yarn guide slot and electronic circuitry associated therewith responsive to beam variations to produce defect signals signifying yarn stoppage, entanglements and defects.

18. Apparatus as defined in claim 17, including a yarn cutter gate device on each mast assembly adjacent the portion of each yarn path between said yarn threading guide means and the associated tension control device, each yarn cutter gate device including a cutter blade and blade support member positioning a cutting edge of the blade at a location to cut the yarn being drawn by the warper along each yarn path portion when not guarded against contact with said cutting edge, a gate-forming guard lever arm, pivoted near its upper end and having a vertically elongated gate edge intercepting the yarn path to engage the yarn and space it from the cutting edge and having a lower end for abutment with a magnet pole member, an electromagnet for magnetically attracting the guard lever arm to abut the pole member at a position causing the yarn to clear the cutting edge, the guard lever arm being pivoted to break away from the pole member when yarn tension reaches a predetermined value and expose the yarn to be cut by the cutting edge.

19. Apparatus as defined in claim 17, including signalling means including a lamp and associated signal circuitry on each mast assembly in the upper portion thereof electrically coupled to all of the yarn motion sensors of the associated mast assembly, the signal circuitry having means for illuminating said lamp when any of the yarn motion sensors of its associated mast detects a yarn stoppage or changes indicating fuzz or lint occurring in the portion of the associated yarn guide slot normally occupied by the yarn and means maintaining the illuminated lamp in on condition until manually deactivated.

20. Apparatus as defined in claim 1, including a yarn cutter gate device on each mast assembly adjacent the portion of each yarn path between said yarn threading guide means and the associated tension control device, each yarn cutter gate device including a cutter blade and blade support member positioning a cutting edge of the blade at a location to cut the yarn being drawn by the warper along each said yarn path portion when not guarded against contact with said cutting edge, a gate-forming guard lever arm pivoted near its upper end and having a vertically elongated gate edge intercepting the yarn path to engage the yarn and space it from the cutting edge and having a lower end for abutment with a magnet pole member, an electromagnet for magnetically attracting the guard lever arm to abut the pole member at a position causing the yarn to clear the cutting edge, the guard lever arm being pivoted to break away from the pole member when yarn tension reaches a predetermined value and expose the yarn to be cut by the cutting edge.

21. A yarn cutter gate for yarn threading stations of threading means for creel systems wherein the threading stations are located adjacent the respective yarn feed off paths from the respective packages, said yarn cutter gate device being located along a portion of the yarn feed off path of an associated yarn supply package of the creel and comprising a cutter blade and blade support member positioning a cutting edge of the blade at a location to cut the yarn being drawn by a warper along each said yarn path portion when not guarded against contact with said cutting edge, a gate-forming guard lever arm pivoted near its upper end and having a vertically elongated gate edge intercepting the yarn path to engage the yarn and space it from the cutting edge and having a lower end for abutment with a magnet pole member, an electromagnet for magneticlly attracting the guard lever arm to abut the pole member at a position causing the yarn to clear the cutting edge, the guard lever arm being pivoted to break away from the pole member when yarn tension reaches a predetermined value and expose the yarn to be cut by the cutting

* * * * *